US008193435B1

(12) United States Patent
Lombardi et al.

(10) Patent No.: US 8,193,435 B1
(45) Date of Patent: Jun. 5, 2012

(54) SNARE BRIDGE APPARATUS

(75) Inventors: Donald G. Lombardi, Westlake Village, CA (US); Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 110 days.

(21) Appl. No.: 12/802,129

(22) Filed: Jun. 1, 2010

Related U.S. Application Data

(60) Provisional application No. 61/217,263, filed on Jun. 1, 2009.

(51) Int. Cl.
*G10D 13/02* (2006.01)

(52) U.S. Cl. ..... 84/413

(58) Field of Classification Search ..... 84/411 R, 84/413–415
See application file for complete search history.

(56) References Cited

U.S. PATENT DOCUMENTS 4,138,920 A 2/1979 Meador
7,700,864 B1 * 4/2010 Sikra ..... 84/413

* cited by examiner

*Primary Examiner* — Kimberly Lockett
(74) *Attorney, Agent, or Firm* — William W. Haefliger

(57) ABSTRACT

A snare positioner configured to extend proximate a drum head comprising an elongated bar means having a length to extend crosswise of the head, first and second holders proximate opposite ends of the bar means, snare wires having opposite ends connected to the holders, the first holder integral with the bar means, the other holder slidably connected to the bar means, and first adjuster means associated with the other holder and bar means for adjusting the position of the other holder lengthwise of the bar means, to adjust the tension of the snare wires.

23 Claims, 7 Drawing Sheets

SNARE BRIDGE APPARATUS

This application claims priority from provisional application Ser. No. 61/217,263 filed Jun. 1, 2009.

BACKGROUND OF THE INVENTION

This invention relates generally to drum snare adjustment, and more particularly to snare wire protection as well as improvements in adjustment of snare wires.

There is need for improvements in snare wire positioning, both lengthwise and also spacial adjustment toward and away from drum heads. There is also need for the structural apparatus enabling such positioning and adjustments, as disclosed herein.

SUMMARY OF THE INVENTION

It is a major object of the invention to provide improvements as referred to. Basically, the invention is embodied in a snare wire positioner structure configured to extend proximate a drum head, and that comprises a) an elongated bar means having a length to extend crosswise of the head, b) first and second holders proximate opposite ends of the bar means, c) snare wires having opposite ends connected to the holders, d) the first holder integral with the bar means, e) the other holder slidably connected to the bar means, f) and first adjuster means associated with the other holder and bar means for adjusting the position of the other holder lengthwise of the bar means, to adjust the tension of the snare wires.

As will be seen, the bar means typically comprises two parallel bars, and the holders extend in bridging relation to the bars.

Another object is to provide the adjustable means in the form of a slider extending in sliding relation to a holder, and an adjuster carried by that holder and slider to be rotatably adjusted for variably stretching the snare wires.

A further object comprises provision of clamping structure to clamp the bar means to drum hoop structure proximate the drum head. That clamping structure may advantageously comprise a tether or tethers adjustably and flexibly retaining an end or opposite ends of the bar means to the drum structure, proximate the drum head or heads. Such tether or tethers may comprise retainer wires whose effective positions may be adjusted. Such adjustment may include wire effective length adjustment, as well as wire bodily positioning adjustment, as by operation of a throw-off device.

Yet another object includes provision of suspension elements for flexibly suspending opposite ends of the bar means to drum structure that extends about a drum head. Such elements may include suspension wires, the effective length of at least one of such wires being adjustable, whereby the suspension spacing of the bar means related to the drum head is adjustable.

Yet another object is to provide a protector or protectors carried by drum structure and projecting to engage a surface, to protect said bar means against surface engagement.

These and other objects and advantages of the invention, as well as the details of an illustrative embodiment, will be more fully understood from the following specification and drawings, in which:

DRAWING DESCRIPTION

DETAILED DESCRIPTION

Figure 1:
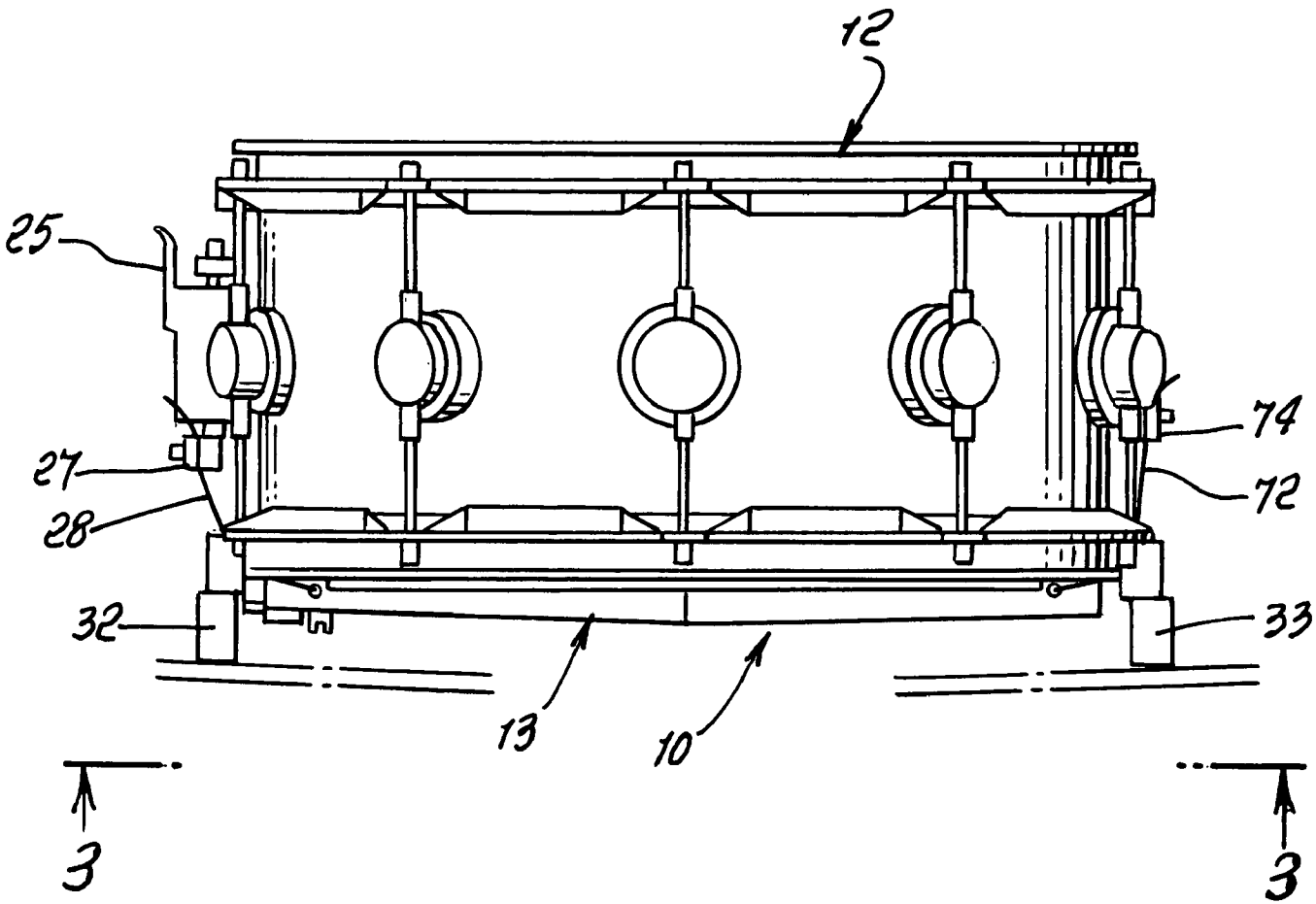
FIG. 1 is a side elevation showing preferred apparatus incorporating the invention.
Figure 2:
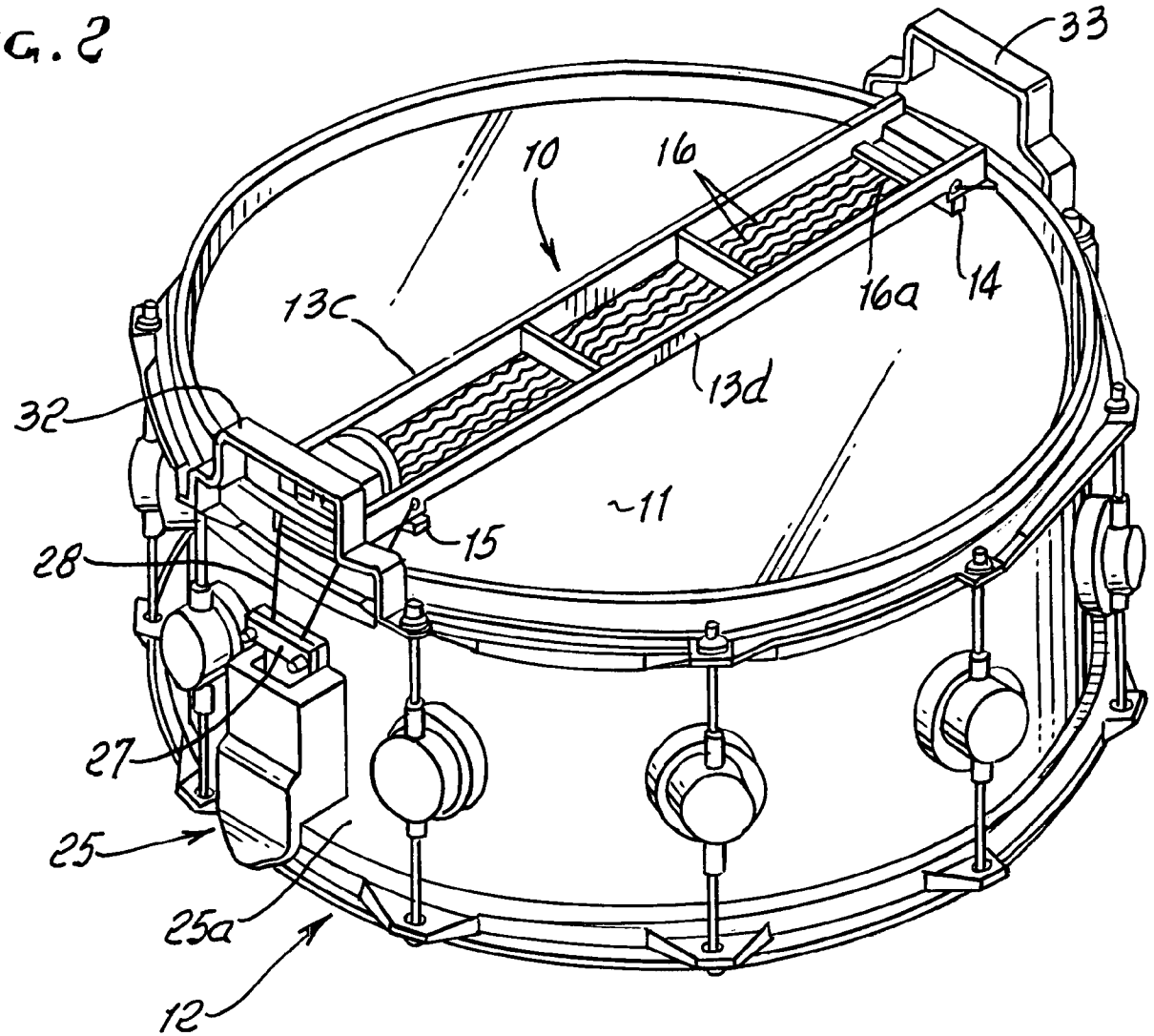
FIG. 2 is an inverted, perspective view of the FIG. 1 apparatus.
Figure 3:
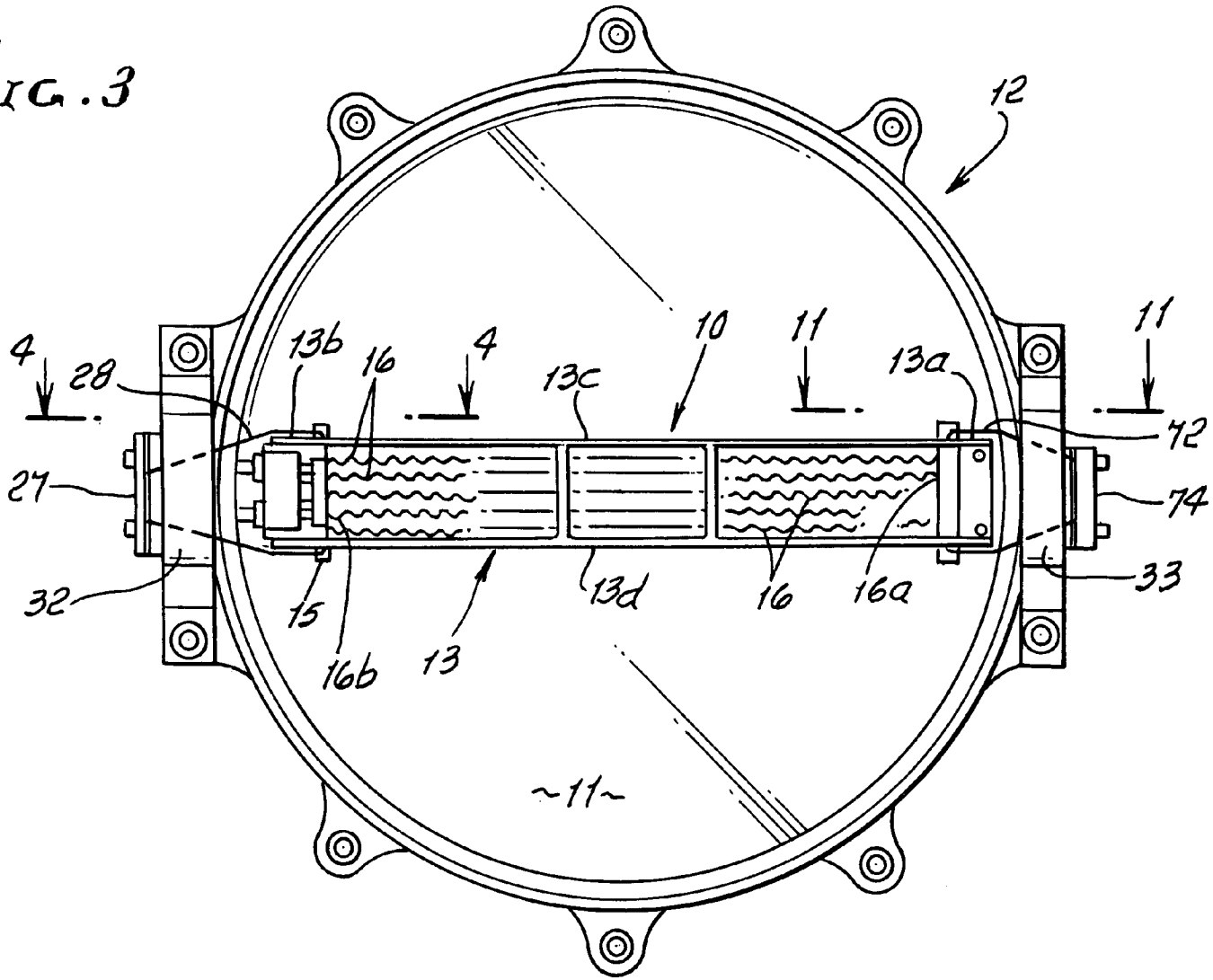
FIG. 3 is a bottom plan view of the FIGS. 1 and 2 apparatus.

Referring to FIGS. 1-3, they show a preferred form of the apparatus, which generally includes a snare positioner 10 configured to extend proximate the head 11 of a drum 12. The positioner includes:

a) elongated metallic bar means 13 having a longitudinal length to extend crosswise of the drum head 11;

b) first and second holders 14 and 15, in bridge form, proximate opposite ends 13*a* and 13*b* of the bar means, and associated therewith;

c) multiple snare wires 16 having opposite ends, as at 16*a* and 16*b*, connected to the holders 14 and 15;

d) the first holder 14 typically integral with or connected to the bar means;

e) the other holder 15 slidably connected to the bar means, to adjustably slide generally longitudinally;

f) and adjusting means 17 associated with the other holder 15, and the bar means, for adjusting the position of holder 15, lengthwise of the bar means, to adjust the tension of the snare wires.

Figure 4:
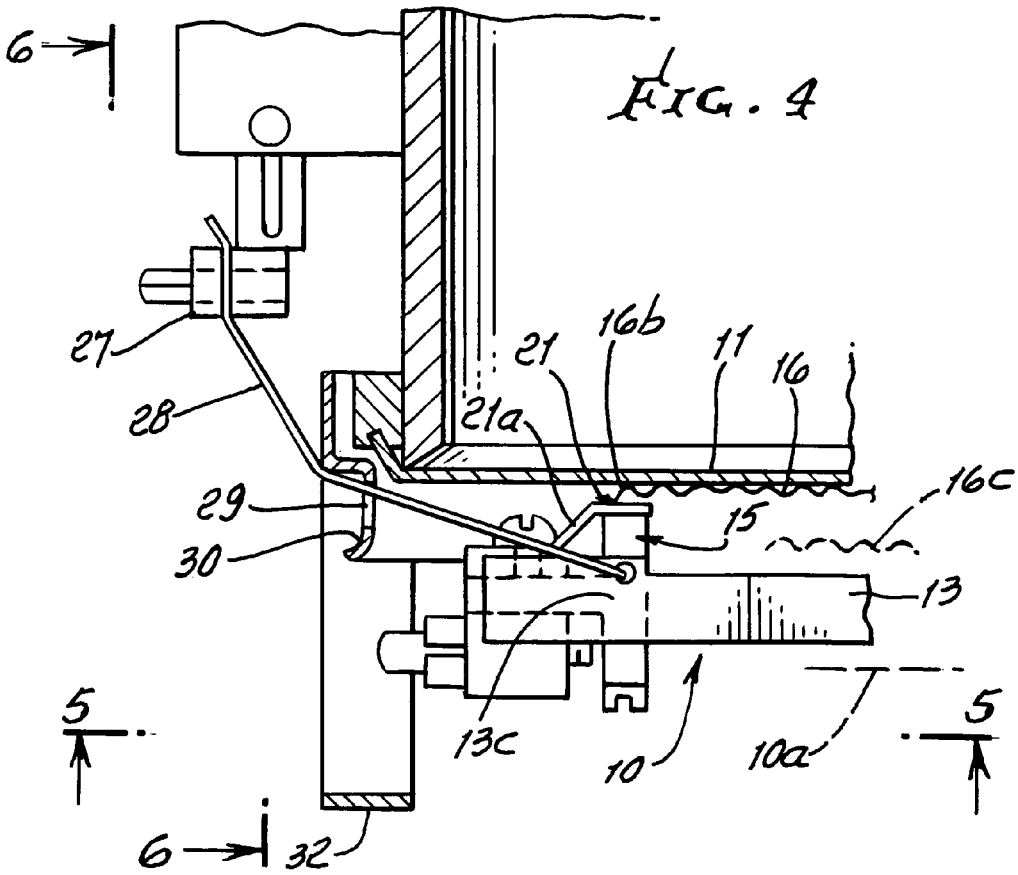
FIG. 4 is an enlarged vertical section taken on lines 4-4 of FIG. 3.
Figure 5:
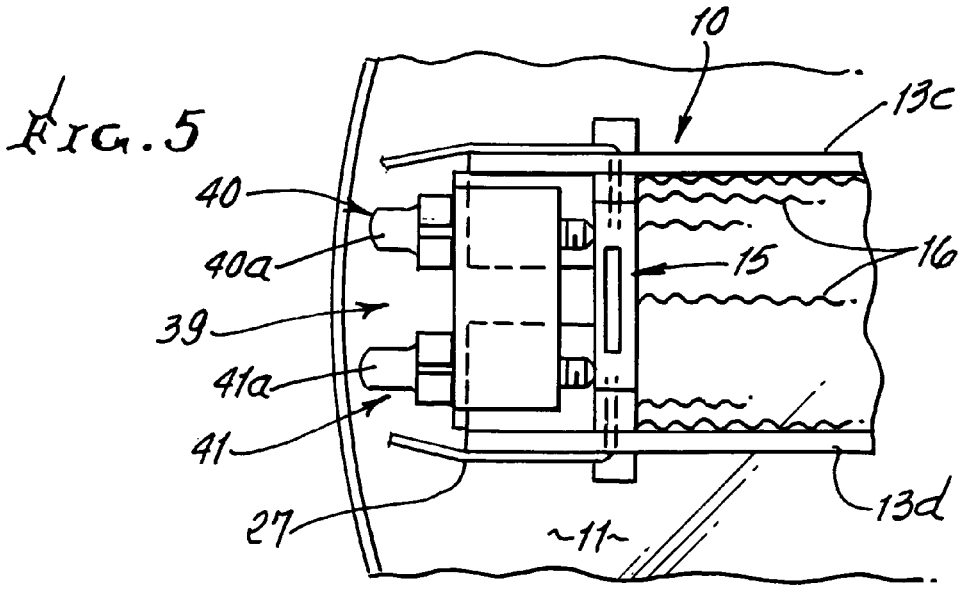
FIG. 5 is a bottom plan view taken on lines 5-5 of FIG. 4.
Figure 6:
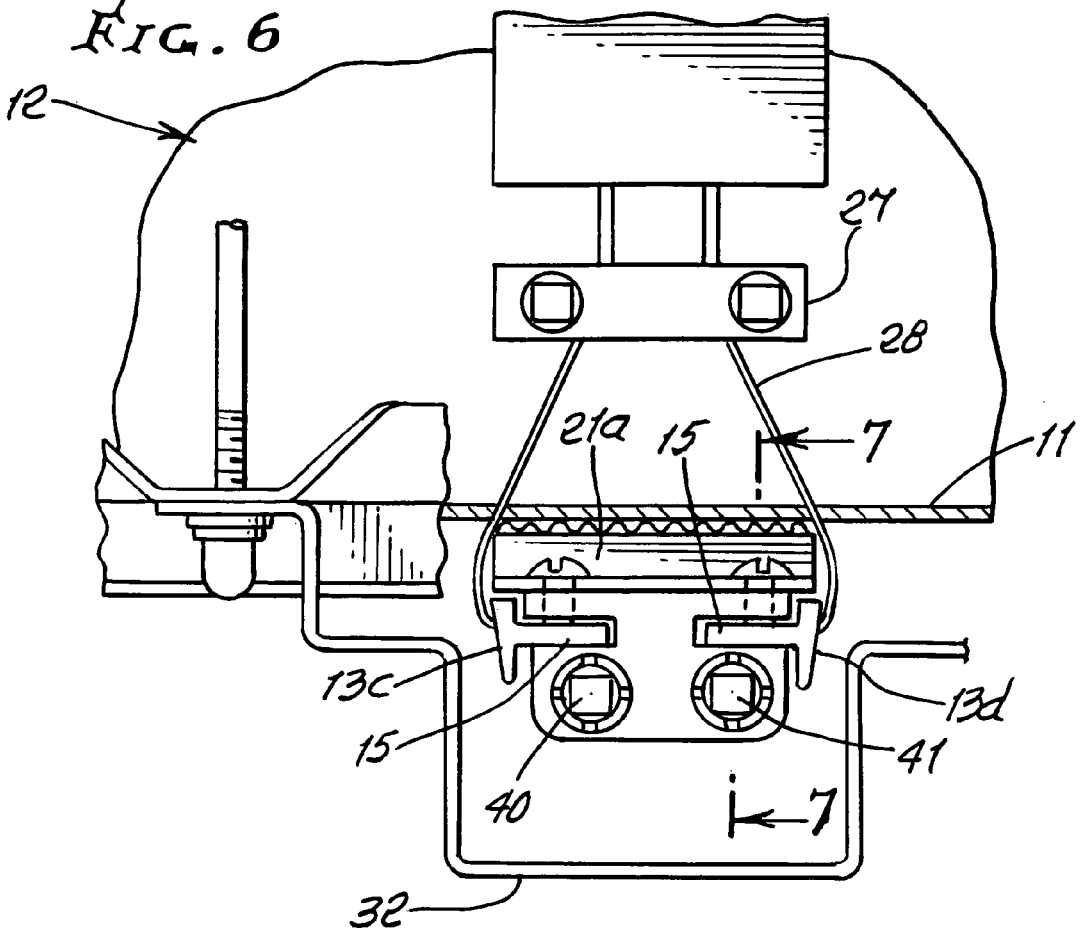
FIG. 6 is a side view taken on lines 6-6 of FIG. 4.

When the drum is in FIGS. 1, 4 and 6 position, i.e. drum head 11 facing downwardly, the snare wires are carried as at 20 and 21 with their ends 16*a* and 16*b*, held elevated above the bar means 13, by Z brackets 20*a* and 21*a* which typically include two laterally spaced, and longitudinally extending metal bars 13*c* and 13*d*, in all up-down positions of the bars, for protection. A throw-off lever 25, at the drum side 25*a*, is pivotable between up position, as exists in FIGS. 4 and 6, with snare wires adjacent the head 11, and down position as seen in FIG. 2 in which the bar means and snare wires are lowered to space the wires below and out of head striking position. See broken lines 16*c* and 10*a* in FIG. 4.

Attached to the lever 25 is a clamp 27, to which the ends of suspension wire 28 are attached. That wire extends downwardly to pass through an opening or openings 29 in drum annulus or hoop 30, and then to attach to the end portion 13*e* of the bar means as seen in FIG. 4. When the throw-off lever is lowered, the wire 28 lowers the connection 13*e* which lowers the bar means 13 and the snare wires 16, away from the drum head 11, the wires 16 remaining protected by the bar means 13 from engagement with any structure below the bar means. Protectors 32 and 33, attached to the drum, project downwardly below all levels of the bar means, to further support and protect the bar means and wires 11 when the drum is placed downwardly as on a support surface engaged by projecting lower ends of the protectors.

Reference is now made to adjustable tensioning of the snare wires, as by longitudinal adjustment as for sliding of the position of the wire holder 15 lengthwise with respect to holder 14.

Figure 7:
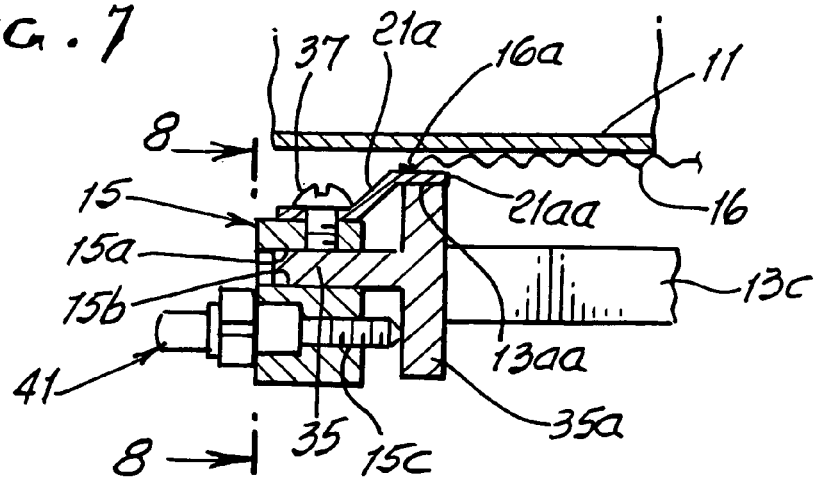
FIG. 7 is an enlarged elevation taken on lines 7-7 of FIG. 6.

Referring to FIGS. 4, 6 and 7, holder 15 is horizontally slidably connected to the bar means wing flange 35, the latter adjustably extending between holder surfaces 15*a* and 15*b*. The holder is connected via bracket 21*a* to the snare wire connection at 16*a*. Fastener 37 connects 21*a* to 15, as shown, adjustably connects 15 to 35, and holds bracket 21*a* in position. Bracket end 21*aa* slides on the bar means, as at 13*aa*.

A first adjuster 39 is associated with the elements 15 and 35 for adjusting the position of the holder 15 lengthwise of the bar means, to adjust the tensioning of the snare wires. Adjuster 39 includes two laterally spaced and independently adjustable fasteners 40 and 41. As the heads 40*a* and 41*a* of those fasteners are rotated, their threaded shanks lengthwise adjust in threaded openings 15*c* in 15, the ends of the fasteners transmitting force to flange 35*a* of the bar means. See FIG. 7. This longitudinally adjusts the holder or bridge 15, relative to bar 13.

Figure 8:
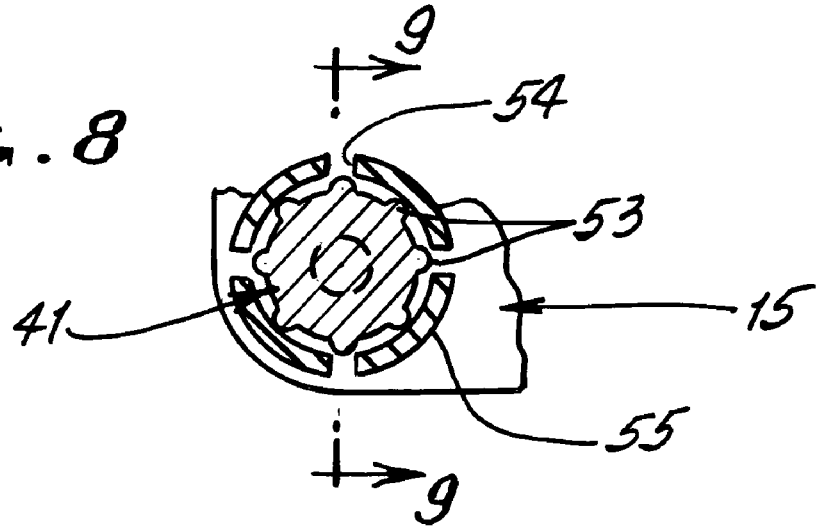
FIG. 8 is an end view taken on lines 8-8 of FIG. 7.
Figure 9:
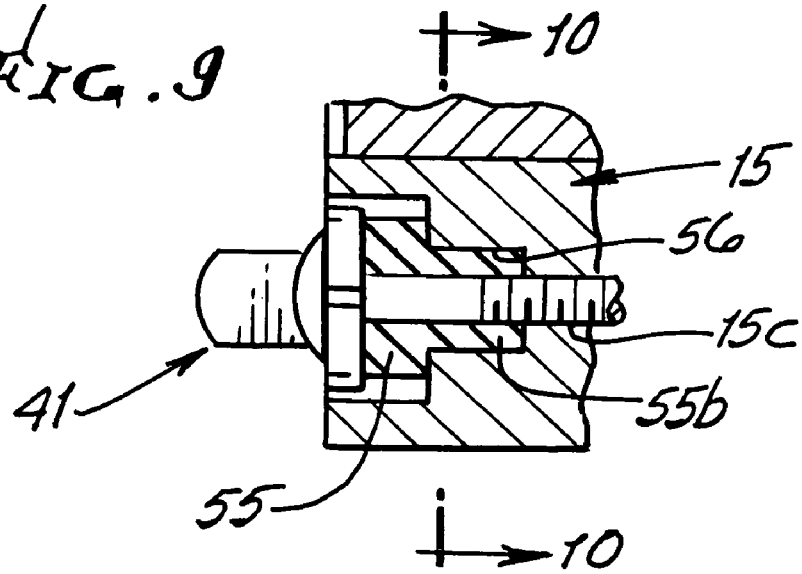
FIG. 9 is a section taken on lines 9-9 of FIG. 8.
Figure 10:
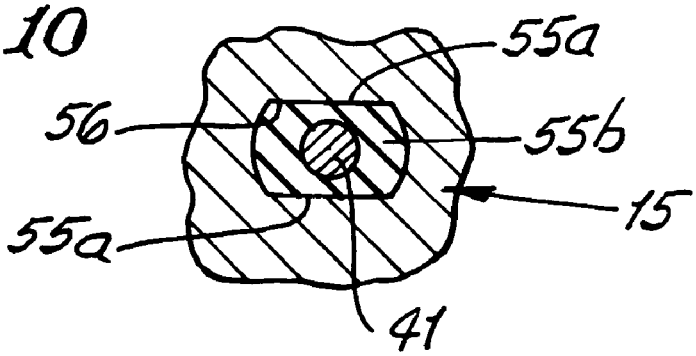
FIG. 10 is a section taken on lines 10-10 of FIG. 9.

Referring to FIGS. 8-10, the heads of fasteners 40 and 41 have peripheral protrusions 53 that forcibly engage in slots 54 of in annular elastomer insert 55, slightly deflecting the insert, and acting to prevent the heads from rotating out of position due to vibration existent during drum playing. This prevents loosening of the selected tension exerted on the drum strands, acting to "tune" the strands. FIG. 10 shows side flats 55*a* of the insert extension 55*b* fitting in recess 56 in 15, preventing rotation of the insert 55 out of position. The two fasteners 40 and 41 are independently adjustable to adjust skewing of the holder or bridge 15 relative to the bar flange 35, to control or adjust skewed tensioning of the snares, for further tuning effect.

Figure 11:
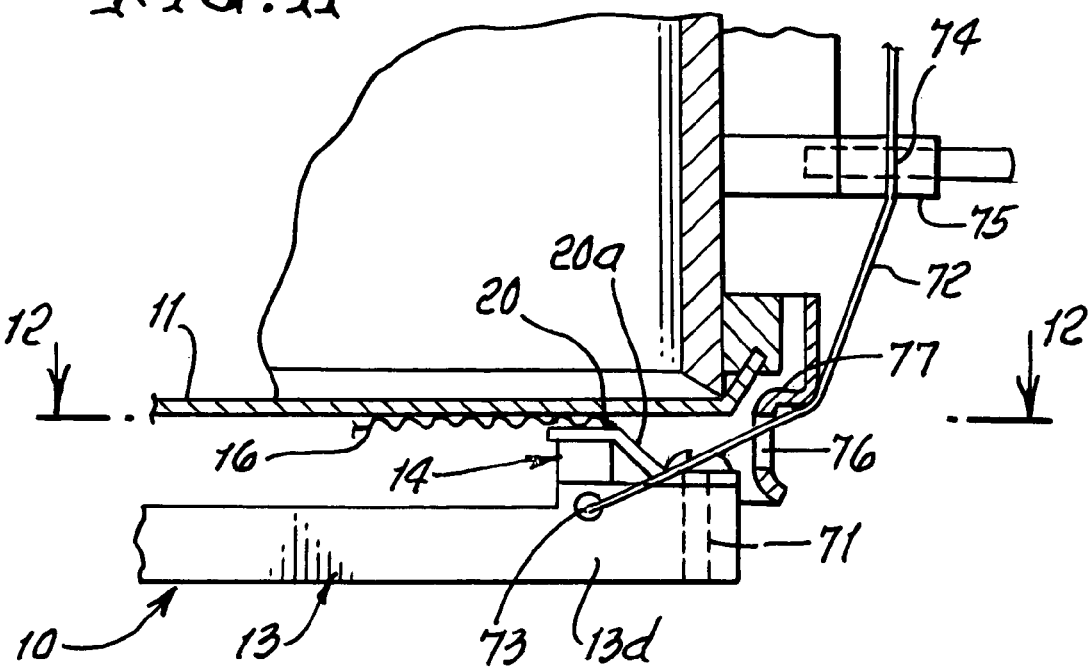
FIG. 11 is an enlarged section taken on lines 11-11 of FIG. 3.
Figure 12:
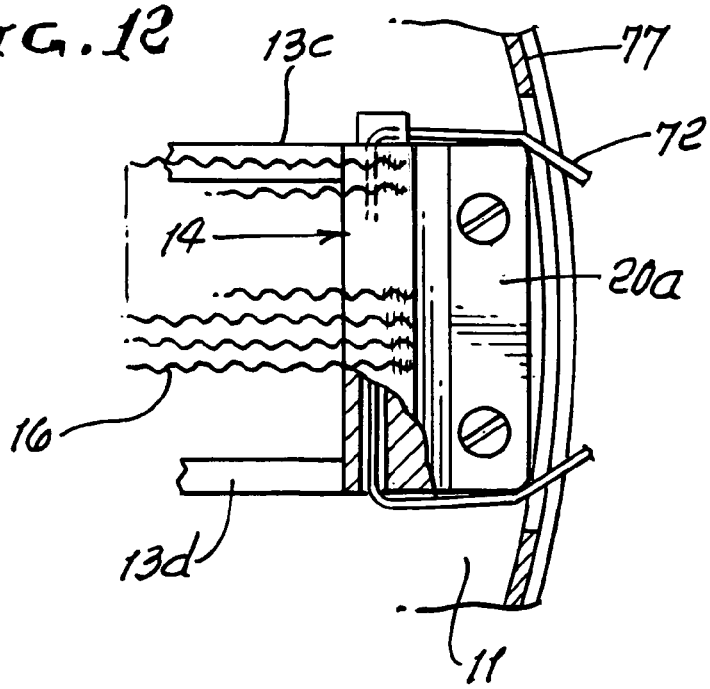
FIG. 12 is a plan view section taken on lines 12-12 of FIG. 11.

FIGS. 11 and 12 show similar attachment of the strand ends to the holder or bridge 14, as via bracket 20*a* attached by fastener 71 to the bridge, but without provision for adjustment. Note also mounting of suspension wire 72 attached to 73 to the opposite end of the bar means, and at 74 to the clamp 75 at the side of the drum. That wire passes through an opening 76 in the drum hoop structure 77. Wire 72 also provide a pivot for the bar means, as its first described end moves up and down due to operation of the throw-off lever.

We claim:

1. A snare positioner configured to extend proximate a drum head comprising a) an elongated bar means having a length to extend crosswise of the head, b) first and second holders proximate opposite ends of the bar means, c) snare wires having opposite ends connected to the holders, d) the first holder integral with the bar means, e) the second holder slidably connected to the bar means, f) and first adjuster means associated with the second holder and bar means for adjusting the position of the second holder lengthwise of the bar means, to adjust the tension of the snare wires.

2. The combination of claim 1 wherein said bar means comprise two parallel bars, and said holders extending in bridging relation to said bars.

3. The combination of claim 1 wherein said adjustable means comprises a slider extending in sliding relation to a holder, and an adjuster carried by that holder and slider to be rotatably adjusted for variably stretching the snare wires.

4. The combination of claim 2 wherein said adjustable means comprises a slider extending between said bars and in sliding relation to a holder, and an adjuster carried by that holder and slider to be rotatably adjusted for variably stretching the snare wires.

5. The combination of claim 1 including clamping structure to clamp the bar means to drum hoop structure proximate the drum head.

6. The combination of claim 5 wherein the clamping structure includes a tether or tethers.

7. The combination of claim 6 including a tether effective length adjuster.

8. The combination of claim 6 including a tether bodily position adjuster including a throw-off device.

9. The combination of claim 4 including clamping means proximate the slider, to clamp the holder and bar means to a drum hoop proximate the drum head.

10. The combination of claim 1 including means for clamping the bar means at its opposite ends to a drum hoop, and so that the second holder can adjustably slide, lengthwise of the bar means.

11. The combination of claim 1 including a drum having structure extending about a drum head, and suspension elements for flexibly suspending opposite ends of the bar means to drum structure that extends about a drum head.

12. The combination of claim 11 wherein said elements include flexible suspension wires.

13. The combination of claim 12 including an adjuster for adjusting the effective length of at least one of the suspension wires.

14. The combination of claim 1 including a protector or protectors carried by drum structure and projecting to engage a surface, to protect said bar means against surface engagement.

15. The combination of claim 1 including adjustable suspension wire structure to adjustably suspend an end of the bar means relative to a drum head, in response to lowering of a throw-off lever at the side of a drum.

16. The combination of claim 1 wherein said first adjustable means includes two adjustable structures for adjusting skewing of the second holder relative to the bar means.

17. The combination of claim 16 wherein said two independently adjustable structures include two laterally spaced fasteners carried by the second holder which is slidably carried by flanges defined by the bar means, said fasteners having ends independently transmitting force to the bar means.

18. The combination of claim 16 including elastomer elements squeezed by the fasteners to block rotation thereof during drum playing vibration.

19. The combination of claim 10 wherein said second holder is configured as a bridge.

20. The combination of claim 4 including means for clasping the bar means at its opposite ends to a drum hoop, and so that the second holder can adjustably slide, lengthwise of the bar means.

21. The combination of claim 4 including a drum having structure extending about a drum head, and suspension elements for flexibly suspending opposite ends of the bar means to drum structure that extends about a drum head.

22. The combination of claim 20 including means for clasping the bar means at its opposite ends to a drum hoop, and so that the second holder can adjustably slide, lengthwise of the bar means.

23. The combination of claim 22 including adjustable suspension wire structure to adjustably suspend an end of the bar means relative to a drum head, in response to lowering of a throw-off lever at the side of a drum.

* * * * *